US009685074B2

(12) United States Patent
McCoy et al.

(10) Patent No.: US 9,685,074 B2
(45) Date of Patent: Jun. 20, 2017

(54) METHOD AND SYSTEM FOR REMOTE INTERACTION WITH ELECTRONIC DEVICE

(71) Applicants: SONY CORPORATION, Tokyo (JP); SONY NETWORK ENTERTAINMENT INTERNATIONAL LLC, Los Angeles, CA (US)

(72) Inventors: Charles McCoy, Coronado, CA (US); True Xiong, San Diego, CA (US); Chunlan Yao, San Diego, CA (US); Justin Gonzales, San Diego, CA (US)

(73) Assignee: SONY CORPORATION, Tokyo (JP)

( * ) Notice: Subject to any disclaimer, the term of this patent is extended or adjusted under 35 U.S.C. 154(b) by 136 days.

(21) Appl. No.: 14/533,333

(22) Filed: Nov. 5, 2014

(65) Prior Publication Data

US 2016/0125731 A1 May 5, 2016

(51) Int. Cl.
*G08C 17/02* (2006.01)

(52) U.S. Cl.
CPC ..... *G08C 17/02* (2013.01); *G08C 2201/93* (2013.01)

(58) Field of Classification Search
CPC .... G08C 17/02; G08C 17/00; G08C 2201/30; G08C 2201/92; G08C 2201/93; G07F 17/00
USPC ..... 340/12.22, 12.5, 12.54, 12.23, 12.52
See application file for complete search history.

(56) References Cited

U.S. PATENT DOCUMENTS

| | | | |
|---|---|---|---|
| 7,095,456 | B2 | 8/2006 | Nakajima |
| 8,621,546 | B2 | 12/2013 | Davidson |
| 8,781,397 | B2 | 7/2014 | Sole |
| 8,818,272 | B2 | 8/2014 | Paryani |
| 2006/0179079 | A1* | 8/2006 | Kolehmainen ..... G06F 9/4862 |
| 2006/0277157 | A1* | 12/2006 | Seidl ..... G06F 17/30528 |
| 2007/0093275 | A1 | 4/2007 | Bloebaum et al. |

(Continued)

FOREIGN PATENT DOCUMENTS

| | | | |
|---|---|---|---|
| EP | 2083385 | A1 | 7/2009 |
| GB | 2489688 | A | 10/2012 |
| WO | 2011035412 | A1 | 3/2011 |
| WO | 2012112715 | A2 | 8/2012 |

OTHER PUBLICATIONS

Hunter Skipworth, "Creative Updates Sound Blaster Range With New EVO ZXR Flagship Headset", June 12, 2013, "http://www.pocket-lint.com/news/121677-creative-updates-sound-blaster-range-with-new-evo-zxr-flagship-headset".

(Continued)

*Primary Examiner* — Allen T Cao
(74) *Attorney, Agent, or Firm* — Chip Law Group

(57) ABSTRACT

Various aspects of a method and system for remote interaction with an electronic device via a user interface are disclosed herein. In an embodiment, the method comprises establishment of a first communication channel between a first electronic device and a second electronic device by use of a first communication protocol. A second communication channel is dynamically established with the second electronic device based on the established first communication channel. The second communication channel uses a second communication protocol. Data associated with the second electronic device is received by the first electronic device. The data is received via the established second communication channel.

29 Claims, 8 Drawing Sheets

(56) References Cited

U.S. PATENT DOCUMENTS

| | | | | |
|---|---|---|---|---|
| 2007/0198432 | A1* | 8/2007 | Pitroda | G06Q 20/02 705/64 |
| 2009/0183117 | A1* | 7/2009 | Chang | G06F 17/248 715/810 |
| 2010/0033318 | A1* | 2/2010 | Tampke | H04M 11/002 340/531 |
| 2013/0081090 | A1 | 3/2013 | Lin et al. | |
| 2013/0135115 | A1* | 5/2013 | Johnson | G08C 19/00 340/870.02 |
| 2014/0277594 | A1* | 9/2014 | Nixon | G05B 11/01 700/17 |
| 2014/0278995 | A1* | 9/2014 | Tang | G06Q 30/0257 705/14.55 |
| 2014/0304678 | A1* | 10/2014 | Zhang | G06F 8/38 717/105 |
| 2015/0170065 | A1* | 6/2015 | Zenger | G06Q 10/063 705/7.11 |
| 2016/0162539 | A1* | 6/2016 | Yun | G06F 17/30398 707/771 |
| 2016/0191501 | A1* | 6/2016 | Li | H04L 41/28 726/6 |

OTHER PUBLICATIONS

"Pioneer DEH-X6600BT CD Receiver With Mixtrax(TM), Bluetooth(R), Android(TM) Media Access, 2 Sets" Sep. 20, 2013, "http://www.pioneerelectronics.com/PUSA/Car/CD-Receivers/DEH-X660OBT".

"Philips Soundstage Speaker: Powerful Sound to Enhance Any TV", Koninklijke Philips N.V., May 20, 2014, "http://download.p4c.philips.com/files/h/htl4111b_12/ht14111b_12_pss_.pdf".

"Myuremote: Universal Remote Control App for Android", Dec. 13, 2012, "http://www.myuremote.com/website/android-universal-remote/".

"TV: TIVO® FAQS", Aug. 20, 2013, Grande Communications Networks LLC, Aug. 20, 2013, "http://web.archive.org/web/20130820164935/http:/mygrande.com/tivo-faqs/".

"3D : What Is Smart View Feature in Samsung Smart TV ?", Samsung, March 24, 2013, "http://skp.samsungcsportal.com/integrated/popup/FaqDetailPopup3.jsp?cdsite=in&seq=871131#".

"Eonon Universal Remote Control","https://www.youtube.com/watch?v=BE_M_5ydXXQ", Nov. 5, 2013.

* cited by examiner

METHOD AND SYSTEM FOR REMOTE INTERACTION WITH ELECTRONIC DEVICE

FIELD

Various embodiments of the disclosure relate to remote interaction with an electronic device. More specifically, various embodiments of the disclosure relate to remote interaction with an electronic device, via a user interface.

BACKGROUND

With advancements in the digital era, not only have the number of electronic devices used in a household increased, the functionalities associated with such devices, such as a smartphone and a Television (TV), have also increased. Multiple user interfaces or modified hardware accessories, may be required to facilitate remote interaction with multiple devices. Further, user participation and/or end-user configurations may be required to facilitate a seamless remote interaction. In certain scenarios, a user may want to control such devices efficiently with a single user interface. However, such user interfaces may not optimize usage and minimize user effort for seamless and enhanced user experience. For example, while watching a favorite program on the TV in a room, a user may need to go to another room. In such a case, the user may miss some interesting moments or scenes in the program. Such a viewing experience may be undesirable.

Further limitations and disadvantages of conventional and traditional approaches will become apparent to one of skill in the art, through comparison of described systems with some aspects of the present disclosure, as set forth in the remainder of the present application and with reference to the drawings.

SUMMARY

A method and a system for remote interaction with an electronic device via a user interface substantially as shown in, and/or described in connection with, at least one of the figures, as set forth more completely in the claims.

These and other features and advantages of the present disclosure may be appreciated from a review of the following detailed description of the present disclosure, along with the accompanying figures in which like reference numerals refer to like parts throughout.

DETAILED DESCRIPTION

Figure 1:
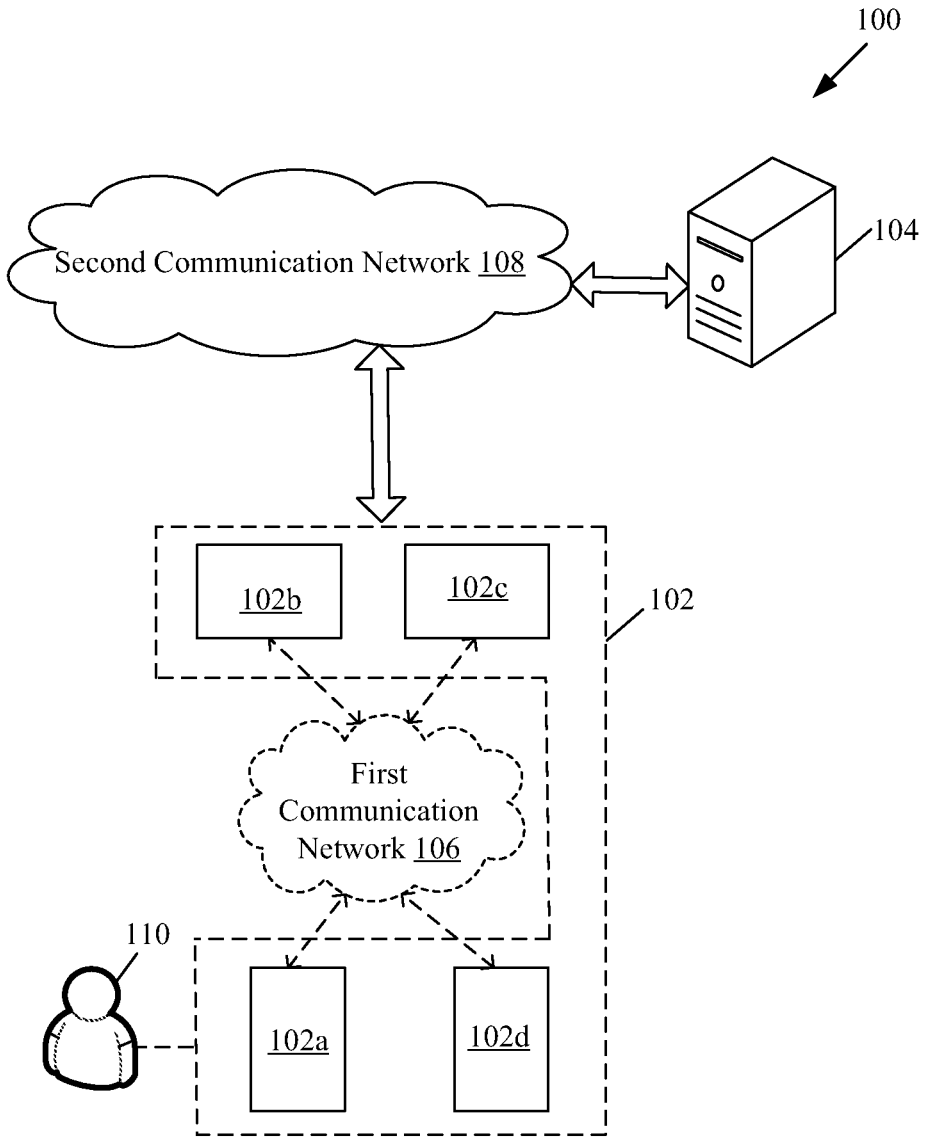
FIG. 1 is a block diagram that illustrates a network environment for remote interaction, in accordance with an embodiment of the disclosure.

Various implementations may be found in methods and systems for remote interaction with an electronic device via a user interface (UI). Exemplary aspects of the disclosure may comprise a method that may establish a first communication channel between a first electronic device and a second electronic device by use of a first communication protocol. A second communication channel may be dynamically established with the second electronic device based on the established first communication channel. The second communication channel may use a second communication protocol. Data associated with the second electronic device may be received by the first electronic device. The data may be received via the established second communication channel.

In an embodiment, the first communication channel may be established based on one or both of a physical contact and/or a close proximity between the first electronic device and the second electronic device. In an embodiment, the first communication protocol corresponds to one of a Near Field Communication (NFC) protocol and/or a Universal Serial Bus (USB) protocol. In an embodiment, the second communication protocol may correspond to one of a Bluetooth protocol, an infrared protocol, a Wireless Fidelity (Wi-Fi) protocol, and/or a ZigBee protocol.

In an embodiment, the method may comprise dynamic generation of a UI based on the received data. The received data may be control information that corresponds to an identification data of the second electronic device and one or more functionalities of the second electronic device.

In an embodiment, the method may comprise display of the generated UI on a display screen of the first electronic device. In an embodiment, the method may comprise receipt of input via the displayed UI for customization of the UI. The customization may correspond to selection and/or rearrangement of one or more UI elements of the UI.

In an embodiment, the method may comprise receipt of an input via the displayed UI to control the second electronic device. In an embodiment, the method may comprise dynamic update of the displayed UI that comprises one or more UI elements, based on another control information received from a third electronic device. The third electronic device may be communicatively coupled to the first electronic device.

In an embodiment, the method may comprise receipt of an input to dynamically control the second electronic device and/or the third electronic device, via the updated UI. In an embodiment, each control element of the one or more UI elements may correspond to one of a functionality associated with the second electronic device, a functionality associated with the third electronic device, and/or a common functionality associated with both the second electronic device and the third electronic device.

In an embodiment, the method may comprise receipt of an input via the UI to assign access privileges for media content to one or more other electronic devices, such as the third electronic device or a fourth electronic device. The one or more other electronic devices may be different from the first electronic device and the second electronic device. The one or more other electronic devices, such as the fourth electronic device may be communicatively coupled to the first electronic device. In an embodiment, the method may comprise storage of user profile data associated with selection of one or more UI elements on the updated UI. The storage of user profile data may be further associated with the selection of one or more menu items from a menu navigation system of the second electronic device.

In an embodiment, the method may comprise receipt of an input via the displayed UI to receive media content at the first electronic device. The media content may be received from the one or more other electronic devices. In an embodiment, the method may comprise update of one or more UI elements on the updated UI based on the stored user profile data.

In an embodiment, the received data may correspond to media content played at the second electronic device. In an embodiment, the received data may correspond to media content different from media content played at the second electronic device. In an embodiment, the method may comprise display of the received data. The displayed data may correspond to media content.

In an embodiment, the method may comprise receipt of media content that may be displayed on the second electronic device by use of a third communication protocol. Such receipt of media content may occur when the first electronic device is moved beyond a predetermined coverage area of the established second communication channel.

In an embodiment, the method may comprise receipt of media content that may be different from media content displayed on the second electronic device. Such receipt of media content may occur when the first electronic device is moved beyond a predetermined coverage area of the established second communication channel. The receipt of media content may be via the third communication protocol.

In an embodiment, the method may comprise communication of the received data to a third electronic device and/or a fourth electronic device. Such received data may correspond to media content. The third electronic device and/or fourth electronic device may be communicatively coupled with the first electronic device.

Another exemplary aspect of the disclosure may comprise a method for remote interaction via the UI in a first electronic device. The method may comprise establishment of a first communication channel between the first electronic device and a second electronic device. The first communication channel may use a first communication protocol. A second communication channel may be dynamically established based on the established first communication channel. The second communication channel may use a second communication protocol. Data associated with the first electronic device may be communicated to the second electronic device. The data may be communicated via the established second communication channel.

In an embodiment, the first communication channel may be established based on a physical contact, and/or a close proximity between the first electronic device and the second electronic device. In an embodiment, the method may comprise receipt of input from the second electronic device, based on the communicated data, to control the first electronic device. The communicated data may be a control information that corresponds to an identification data of the first electronic device and one or more functionalities of the first electronic device.

In an embodiment, the communicated data may correspond to media content played at the first electronic device. In an embodiment, the communicated data may correspond to media content different from media content played at the first electronic device. In an embodiment, the communicated data may correspond to a media content that may be simultaneously communicated to the second electronic device and a third electronic device. The third electronic device may be communicatively coupled to the first electronic device.

In an embodiment, the method may comprise communication of one media content to the second electronic device. A different media content may be communicated to the third electronic device. In an embodiment, the method may comprise communication of a notification to the second electronic device. Such communication of the notification may occur when an updated content may be available in a menu navigation system of the first electronic device. The updated content may be selected via the second electronic device.

FIG. 1 is a block diagram illustrating a network environment 100 for remote interaction, in accordance with an embodiment of the disclosure. With reference to FIG. 1, there is shown a plurality of electronic devices 102, a server 104, a first communication network 106, a second communication network 108, and one or more users, such as a user 110. The plurality of electronic devices 102 includes a first electronic device 102*a*, a second electronic device 102*b*, a third electronic device 102*c*, and a fourth electronic device 102*d*.

Each of the plurality of electronic devices 102 may be communicatively coupled with each other in the first communication network 106. The first communication network 106 may comprise a plurality of first communication channels (not shown), and a plurality of second communication channels (not shown). In an embodiment, one or more of the plurality of electronic devices 102 may be communicatively coupled with the server 104, via the second communication network 108. In an embodiment, one or more of the plurality of electronic devices 102 may include a display screen (not shown) that may render a UI. In an embodiment, one or more of the plurality of electronic devices 102 may be associated with the user 110.

The first electronic device 102*a* may comprise suitable logic, circuitry, interfaces, and/or code that may be operable to establish a first communication channel with other electronic devices, such as the second electronic device 102*b*. The second electronic device 102*b*, the third electronic device 102*c*, and the fourth electronic device 102*d*, may be similar to the first electronic device 102*a*. Examples of the first electronic device 102*a*, the second electronic device 102*b*, the third electronic device 102*c*, and/or the fourth electronic device 102*d*, may include, but are not limited to, a TV, an Internet Protocol Television (IPTV), a set-top box (STB), a camera, a music system, a wireless speaker, a smartphone, a laptop, a tablet computer, an air conditioner, a refrigerator, a home lighting appliance, consumer electronic devices, and/or a Personal Digital Assistant (PDA) device.

The server 104 may comprise suitable logic, circuitry, interfaces, and/or code that may be operable to receive requests from one or more subscribed devices, such as the plurality of electronic devices 102. The server 104 may be operable to store a master profile. The master profile may comprise information related to device-to-device connections, such as established communicative coupling information associated with the plurality of electronic devices 102. In an embodiment, the server 104 may be operable to store control information for predetermined electronic devices, such as the plurality of electronic devices 102. The server 104 may be implemented by use of several technologies that are well known to those skilled in the art. Examples of the server 104 may include, but are not limited to, Apache™ HTTP Server, Microsoft® Internet Information Services (IIS), IBM® Application Server, and/or Sun Java™ System Web Server.

The first communication network 106 may include a medium through which the plurality of electronic devices 102 may communicate with each other. Examples of the first communication network 106 may include, but are not limited to, short range networks (such as a home network), a 2-way radio frequency network (such as a Bluetooth-based network), a Wireless Fidelity (Wi-Fi) network, a Wireless Personal Area Network (WPAN), and/or a Wireless Local Area Network (WLAN). Various devices in the network environment 100 may be operable to connect to the first communication network 106, in accordance with various wired and wireless communication protocols known in the art. Examples of such wireless communication protocols, such as the first communication protocol may include, but are not limited to, ZigBee, infrared (IR), IEEE 802.11, 802.16, cellular communication protocols, wireless Universal Serial Bus (USB), and/or Bluetooth (BT) communication protocols.

The second communication network 108 may include a medium through which one or more of the plurality of electronic devices 102 may communicate with a network operator (not shown). The second communication network 108 may further include a medium through which one or more of the plurality of electronic devices 102 may receive media content, such as TV signals, and communicate with one or more servers, such as the server 104. Examples of the second communication network 108 may include, but are not limited to, the Internet, a cloud network, a Wireless Fidelity (Wi-Fi) network, a Wireless Local Area Network (WLAN), a Local Area Network (LAN), a telephone line (POTS), and/or a Metropolitan Area Network (MAN). Various devices in the network environment 100 may be operable to connect to the second communication network 108, in accordance with various wired and wireless communication protocols. Examples of such wired and wireless communication protocols, such as the third communication protocol may include, but are not limited to, Transmission Control Protocol and Internet Protocol (TCP/IP), User Datagram Protocol (UDP), Hypertext Transfer Protocol (HTTP), File Transfer Protocol (FTP), IEEE 802.11, 802.16, and/or cellular communication protocols.

The plurality of first communication channels (not shown) may facilitate data communication among the plurality of electronic devices 102. The plurality of first communication channels may communicate data in accordance with various short-range wired or wireless communication protocols, such as the first communication protocol. Examples of such wired and wireless communication protocols, such as the first communication protocol may include, but are not limited to, Near Field Communication (NFC), and/or Universal Serial Bus (USB).

The plurality of second communication channels (not shown) may be similar to plurality of first communication channels, except that the plurality of second communication channels may use a communication protocol different from the first communication protocol. The plurality of second communication channels may facilitate data communication among the plurality of electronic devices 102 in the first communication network 106. The second communication channel, such as a 2-way radio frequency band, may communicate data in accordance with various wireless communication protocols. Examples of such wireless communication protocols, such as the second communication protocol may include, but are not limited to, ZigBee, infrared (IR), IEEE 802.11, 802.16, cellular communication protocols, wireless Universal Serial Bus (USB), and/or Bluetooth (BT) communication protocols.

The display screen (not shown) may comprise suitable logic, circuitry, interfaces, and/or code that may be operable to render a UI that may receive input from the user 110. Such input may be received from the user 110, via a virtual keypad, a stylus, a touch-based input, a voice-based input, and/or a gesture. The display screen may be further operable to render one or more features and/or applications of the electronic devices, such as the first electronic device 102*a*. The display screen may be realized through several known technologies, such as a Liquid Crystal Display (LCD) display, a Light Emitting Diode (LED) display, an Organic LED (OLED) display technology, and/or the like.

In operation, the first electronic device 102*a* may be operable to establish the first communication channel between the first electronic device 102*a* and the second electronic device 102*b*. The first electronic device 102*a* may use the first communication protocol, to establish the first communication channel. In an embodiment, the first communication channel may be established based on a physical contact and/or a close proximity between the first electronic device 102*a* and the second electronic device 102*b*.

In an embodiment, the first electronic device 102*a* may be operable to dynamically establish the second communication channel with the second electronic device 102*b* based on the established first communication channel. The second communication channel may established by use of the second communication protocol.

In an embodiment, the first electronic device 102*a* may be operable to receive data associated with the second electronic device 102*b*. The data may be received via the established second communication channel. The received data may be control information. In an embodiment, the first electronic device 102*a* may be operable to dynamically generate a UI based on the received data.

In an embodiment, the first electronic device 102*a* may be operable to display the generated UI on the display screen of the first electronic device 102*a*. In an embodiment, the first electronic device 102*a* may be operable to receive input, via the displayed UI, for customization of the UI.

In an embodiment, the first electronic device 102*a* may be operable to dynamically update the displayed UI. The update may be based on the control information received from the third electronic device 102*c*.

In an embodiment, the first electronic device 102*a* may be operable to receive an input via the updated UI, to control the second electronic device 102*b* and/or the third electronic device 102*c*. The displayed UI may comprise one or more UI elements.

In an embodiment, the data received at the first electronic device 102*a* may correspond to media content, such as a TV channel, a video on demand (VOD), and/or an audio and video on demand (AVOD). In an embodiment, the first electronic device 102*a* may be operable to receive input via the displayed UI, to receive media content at the first electronic device 102*a*. Such receipt of the media content may be from the second electronic device 102*b* or the third electronic device 102*c*.

In an embodiment, the first electronic device 102*a* may be operable to communicate the received data, such as media content, to the third electronic device 102*c* and/or the fourth electronic device 102*d*. The third electronic device 102*c* and/or fourth electronic device 102*d* may be communicatively coupled with the first electronic device 102*a*.

In accordance with another exemplary aspect of the disclosure, the first electronic device 102*a* may be operable to communicate data associated with the first electronic device 102*a* to the second electronic device 102*b*. The data, such as the control information, may be communicated via the established second communication channel, as described above. In an embodiment, the first electronic device 102*a* may be controlled based on an input received from the second electronic device 102*b*.

In an embodiment, the communicated data may be media content played at the first electronic device 102*a*, and/or media content different from media content played at the first electronic device 102*a*. In an embodiment, the first electronic device 102*a* may be operable to communicate the notification, such as a message, to the second electronic device 102*b*. Such notification may be communicated when an updated content may be available, in the menu navigation system of the first electronic device 102*a*.

In an embodiment, the plurality of electronic devices 102 may be remotely located with respect to each other. In an embodiment, the plurality of electronic devices 102, may exchange information with each other either directly or via the server 104. Such information exchange may occur via the plurality of the second communication channels in the first communication network 106. In an embodiment, such information exchange may occur via the second communication network 108.

For the sake of brevity, four electronic devices, such as the plurality of electronic devices 102, are shown in FIG. 1. However, without departing from the scope of the disclosed embodiments, there may be more than four electronic devices that may communicate with each other directly, or via the server 104.

Figure 2:
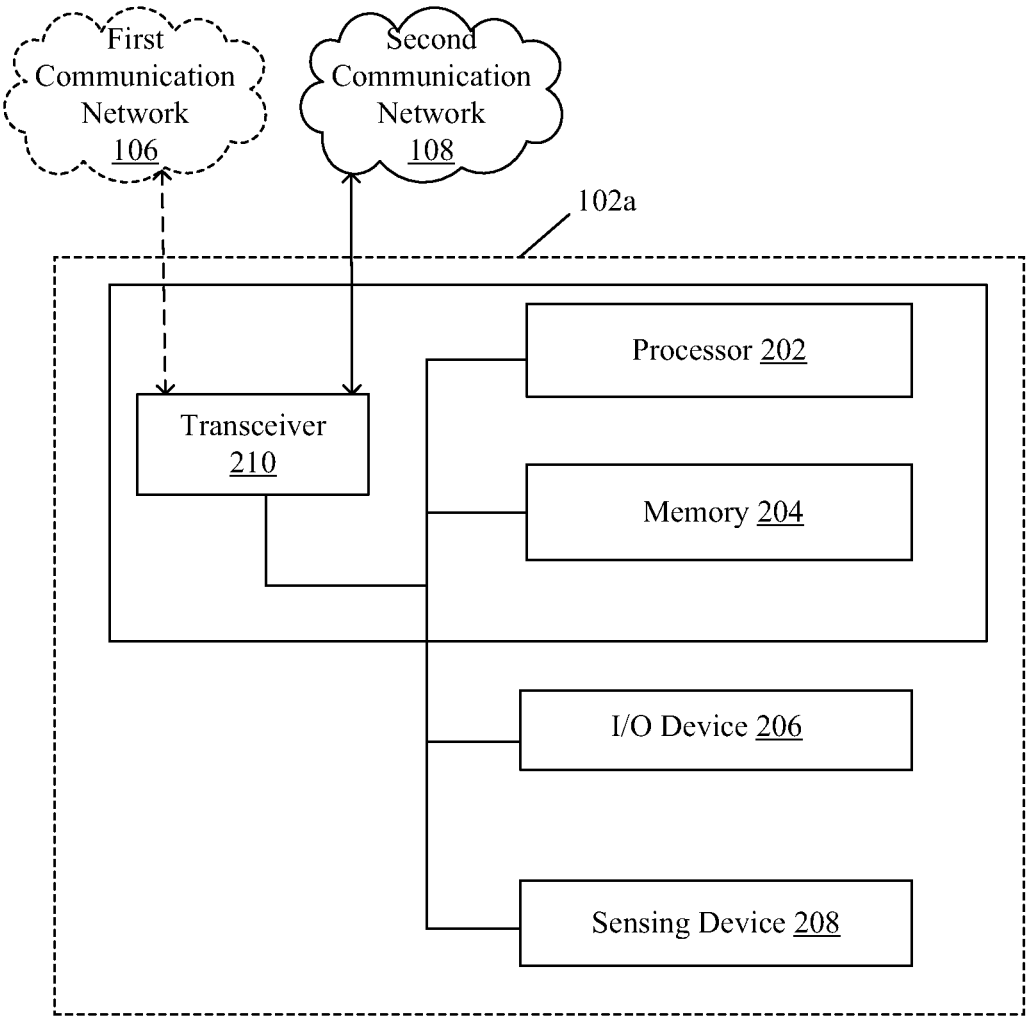
FIG. 2 is a block diagram that illustrates an exemplary electronic device, in accordance with an embodiment of the disclosure.

FIG. 2 is a block diagram illustrating an exemplary electronic device, in accordance with an embodiment of the disclosure. FIG. 2 is explained in conjunction with elements from FIG. 1. With reference to FIG. 2, there is shown the first electronic device 102*a*. The first electronic device 102*a* may comprise one or more processors, such as a processor 202, a memory 204, one or more input/output (I/O) devices, such as an I/O device 206, one or more sensing devices, such as a sensing device 208, and a transceiver 210.

The processor 202 may be communicatively coupled to the memory 204, the I/O device 206, the sensing device 208, and the transceiver 210. The transceiver 210 may be operable to communicate with one or more of the plurality of the electronic devices 102, such as the second electronic device 102*b*, the third electronic device 102*c*, and the fourth electronic device 102*d*, via the first communication network 106. The transceiver 210 may be further operable to communicate with one or more servers, such as the server 104, via the second communication network 108.

The processor 202 may comprise suitable logic, circuitry, interfaces, and/or code that may be operable to execute a set of instructions stored in the memory 204. The processor 202 may be operable to process data that may be received from one or more of the plurality of electronic devices 102. The processor 202 may be further operable to retrieve data, such as user profile data stored in the memory 204. The processor 202 may be implemented based on a number of processor technologies known in the art. Examples of the processor 202 may be an X86-based processor, a Reduced Instruction Set Computing (RISC) processor, an Application-Specific Integrated Circuit (ASIC) processor, a Complex Instruction Set Computing (CISC) processor, and/or other processors.

The memory 204 may comprise suitable logic, circuitry, and/or interfaces that may be operable to store a machine code and/or a computer program with at least one code section executable by the processor 202. In an embodiment, the memory 204 may be operable to store user profile data that may comprise user-related information, such as information of the user 110. In an embodiment, the memory 204 may be further operable to store information related to established device-to-device connections, such as all established device-to-device BT pairing. The memory 204 may be further operable to store one or more speech-to-text conversion algorithms, one or more speech-generation algorithms, and/or other algorithms. The memory 204 may further be operable to store operating systems and associated applications. Examples of implementation of the memory 204 may include, but are not limited to, Random Access Memory (RAM), Read Only Memory (ROM), Hard Disk Drive (HDD), Flash memory, and/or a Secure Digital (SD) card.

The I/O device 206 may comprise suitable logic, circuitry, interfaces, and/or code that may be operable to receive an input from the user 110. The I/O device 206 may be further operable to provide an output to the user 110. The I/O device 206 may comprise various input and output devices that may be operable to communicate with the processor 202. Examples of the input devices may include, but are not limited to, a touch screen, a keyboard, a mouse, a joystick, a microphone, a camera, a motion sensor, a light sensor, and/or a docking station. Examples of the output devices may include, but are not limited to, the display screen and/or a speaker.

The sensing device 208 may comprise suitable logic, circuitry, and/or interfaces that may be operable to store a machine code and/or a computer program with at least one code section executable by the processor 202. The sensing device 208 may comprise one or more proximity sensors operable to detect close proximity among the plurality of electronic devices 102, such as between the first electronic device 102*a* and the second electronic device 102*b*. The sensing device 208 may further comprise one or more magnetic sensors operable to detect physical contact of the first electronic device 102*a* with other electronic devices, such as with the second electronic device 102*b*. The sensing device 208 may further comprise one or more biometric sensors operable to perform voice recognition, facial recognition, user identification, and/or verification of the user 110. The sensing device 208 may further comprise one or more capacitive touch sensors operable to detect one or more touch-based input actions received from the user 110, via the UI.

The transceiver 210 may comprise suitable logic, circuitry, interfaces, and/or code that may be operable to receive or communicate data, via the second communication channel. The received or communicated data may correspond to the control information and/or the media content associated with one or more other electronic devices. The transceiver 210 may be operable to communicate with one or more servers, such as the server 104, via the second communication network 108. In an embodiment, the transceiver 210 may be operable to communicate with a network operator (not shown) to receive media content, such as TV signals, via the second communication network 108. The transceiver 210 may implement known technologies to support wired or wireless communication with the second electronic device 102*b*, and/or the first communication network 106 and the second communication network 108.

The transceiver 210 may include, but is not limited to, an antenna, a radio frequency (RF) transceiver, one or more amplifiers, a network interface, one or more tuners, one or more oscillators, a digital signal processor, a coder-decoder (CODEC) chipset, a subscriber identity module (SIM) card, and/or a local buffer. The transceiver 210 may communicate via wireless communication with networks, such as BT-based network, Internet, an Intranet, and/or a wireless network, such as a cellular telephone network, a wireless local area network (LAN) and/or a metropolitan area network (MAN). Wireless communication may use one or more of a plurality of communication standards, protocols and technologies, such as Global System for Mobile Communications (GSM), Enhanced Data GSM Environment (EDGE), wideband code division multiple access (W-CDMA), code division multiple access (CDMA), time division multiple access (TDMA), Bluetooth, Wireless Fidelity (Wi-Fi) (such as IEEE 802.11a, IEEE 802.11b, IEEE 802.11g and/or IEEE 802.11n), Near Field communication (NFC), wireless Universal Serial Bus (USB), voice over Internet Protocol (VoIP), Wi-MAX, a protocol for email, instant messaging, and/or Short Message Service (SMS).

In an embodiment, the transceiver 210 may comprise two tuners (not shown). The two tuners may be operable to receive and decode different media contents at the same time, such as two TV channels. The processor 202 may be operable to use the output of one tuner to generate display at the display screen of the first electronic device 102*a*. At the same time, the output of another tuner may be communicated to another electronic device, such as the second electronic device 102*b*.

In operation, the processor 202 may be operable to detect close proximity and/or physical contact between the first electronic device 102*a* and the second electronic device 102*b*. Such detection may occur by use of one or more sensors of the sensing device 208.

In an embodiment, the processor 202 may be operable to establish the first communication channel between the first electronic device 102*a* and the second electronic device 102*b*. The first communication channel may be established by use of the first communication protocol, such as the NFC protocol.

In an embodiment, the processor 202 may be operable to dynamically establish the second communication channel with the second electronic device 102*b* based on the established first communication channel. The second communication channel may use the second communication protocol, such as the BT protocol. In an embodiment, the second communication channel, such as the BT pairing, may be established without the need to input a BT pairing code. In an embodiment, the user 110 may not need to provide an input on the second electronic device 102*b* to establish the second communication channel. In an embodiment, the functioning of the second electronic device 102*b* may not be impacted during the establishment of the second communication channel, such as the BT pairing, between the first electronic device 102*a* and the second electronic device 102*b*.

In an embodiment, the processor 202 may be operable to receive data associated with the second electronic device 102*b* by the transceiver 210, via the established second communication channel. The received data may be control information. The control information may correspond to an identification data of the second electronic device 102*b* and one or more functionalities of the second electronic device 102*b*. In an embodiment, the one or more functionalities of the second electronic device 102*b* may be received from the server 104.

In an embodiment, the processor 202 may be operable to dynamically generate the UI based on the received data. In an embodiment, the processor 202 may be operable to display the generated UI on the display screen of the first electronic device 102*a*.

In an embodiment, the processor 202 may be operable to receive input from the user 110, associated with the first electronic device 102*a*. The input may be received from the user 110, via the displayed UI, for customization of the UI. The customization may correspond to selection and/or rearrangement of one or more UI elements, such as control buttons, of the UI. In an embodiment, the sensing device 208 may be configured to receive a touch-based input and/or a touch-less input, from the user 110. In an embodiment, the sensing device 208 may verify and authenticate the user 110 based on various known biometric algorithms. Examples of such biometric algorithms may include, but are not limited to, algorithms for face recognition, voice recognition, retina recognition, thermograms, and/or iris recognition.

In an embodiment, the processor 202 may be operable to receive input, via the displayed UI, to control the second electronic device 102*b*. In an embodiment, the processor 202 may be operable to process and communicate the received input to the second electronic device 102*b*. Such communicated input may be a control command, which may be communicated via the transceiver 210. The input may generate a response in the second electronic device 102*b*.

In an embodiment, the processor 202 may be operable to dynamically update the displayed UI. The update may be based on other control information received from the third electronic device 102*c*. The other control information may be received via one of the plurality of second communication channels, by use of the second communication protocol, such as the BT protocol.

In an embodiment, the processor 202 may be operable to receive an input to control the second electronic device 102*b* and/or the third electronic device 102*c*, via the updated UI. Each UI element, such as a control button, on the updated UI may correspond to one of a functionality associated with the second electronic device 102*b*, a functionality associated with the third electronic device 102*c*, and/or a common functionality associated with both of the second electronic device 102*b* and the third electronic device 102*c*.

In an embodiment, the processor 202 may be operable to communicate the received input to the second electronic device 102*b*, via the transceiver 210. In an embodiment, the processor 202 may be operable to control different electronic devices, such as the second electronic device 102*b* and the third electronic device 102*c*, of the same make and model, from the updated UI. The control may be for a same functionality, such as contrast change. Such UI may comprise separate UI elements to unambiguously process and communicate control commands to the different electronic devices.

In an embodiment, the processor 202 may be operable to receive input, via the UI, to assign access privileges for media content to one or more other electronic devices, such as the third electronic device 102*c* and/or the fourth electronic device 102*d*. The one or more other electronic devices may be communicatively coupled to the first electronic device 102*a*. The communicative coupling may occur via one of the plurality of second communication channels by use of the second communication protocol, such as the BT protocol. In an embodiment, the communicative coupling may use the third communication protocol, such as the TCP/IP protocol, which may be different from the second communication protocol.

In an embodiment, the processor 202 may be operable to store user profile data associated with selection of the one or more UI elements on the updated UI. In an embodiment, the user profile data may further associated with selection of one or more menu items from a menu navigation system of the second electronic device 102*b*. Such user profile data may be stored in the memory 204. In other words, the user profile data may further comprise information that may correspond to a historical usage pattern of the one or more UI elements on the updated UI.

In an embodiment, the processor 202 may be operable to update one or more UI elements on the updated UI based on the stored user profile data. In an embodiment, such an update may correspond to dynamic generation of UI elements, which may be different from the one or more UI elements of the generated UI. Such an update may be based on the stored user profile data. Examples of UI elements may include, but may not be limited to control buttons, menu items, check boxes, radio buttons, sliders, movable dials, selection lists, and/or graphical icons. In an embodiment, the processor 202 may be operable to implement artificial intelligence to learn from the user profile data stored in the memory 204. The processor 202 may implement artificial intelligence based on one or more approaches, such as an artificial neural network (ANN), an inductive logic programming approach, a support vector machine (SVM), an association rule learning approach, a decision tree learning approach, and/or a Bayesian network. Notwithstanding, the disclosure may not be so limited and any suitable learning approach may be utilized without limiting the scope of the disclosure.

In an embodiment, the processor 202 may be operable to receive input, via the displayed UI, to select media content at the first electronic device 102*a*. Such selected media content may be received from the second electronic device 102*b* or the third electronic device 102*c* that may be controlled by the processor 202. In an embodiment, such media content may be received as decoded data from the second electronic device 102*b*. In such an embodiment, the second electronic device 102*b* may comprise one or more tuners that may be operable to decode media content received in encoded form from the network operator.

In an embodiment, the processor 202 may be operable to receive and/or play media content played at the second electronic device 102*b*, such as the TV or the music system. In an embodiment, the processor 202 may be operable to receive and/or play the media content that may be different from the media content played at the second electronic device 102*b*. In an embodiment, the processor 202 may be operable to receive another media content in a format different from a format of the media content received at the second electronic device 102*b*.

In an embodiment, the processor 202 may be operable to receive and/or display the media content at the second electronic device 102*b*, by use of the third communication protocol. In an embodiment, the processor 202 may be operable to receive and/or display the media content that may be same or different from media content displayed at the second electronic device 102*b*. Such receipt, via the transceiver 210, and/or display of the media content may occur dynamically when the processor 202 is moved beyond a predetermined coverage area of the established second communication channel (such as the BT range).

In an embodiment, the processor 202 may be operable to communicate the received data, which may correspond to the media content, to the third electronic device 102*c* (such as a smartphone), and/or the fourth electronic device 102*d* (such as a music system). In an embodiment, such media content may be communicated as decoded media content. Such communication may occur via the transceiver 210.

In accordance with another exemplary aspect of the disclosure, the processor 202 may be operable to communicate data associated with the first electronic device 102*a* (such as a TV), to the second electronic device 102*b* (such as a smartphone). The data may be communicated by use of the transceiver 210 via the established second communication channel.

In an embodiment, the processor 202 may be operable to receive input from the second electronic device 102*b*, to control the first electronic device 102*a*. The received input may be based on the data communicated to the second electronic device 102*b*. The communicated data may be the control information. The control information may correspond to the identification data and the one or more functionalities of the first electronic device 102*a*.

In an embodiment, the communicated data may be media content played at the first electronic device 102*a*, and/or media content different from media content played at the first electronic device 102*a*. In an embodiment, the processor 202 may be operable to communicate the media content to one or more electronic devices simultaneously, via the transceiver 210. In an embodiment, the processor 202 may be operable to communicate the media content to the second electronic device 102*b*, and a different media content to another electronic device, such as the third electronic device 102*c*. In an embodiment, the processor 202 may be operable to communicate two different media contents to the second electronic device 102*b*, via the transceiver 210. In an embodiment, such communication of different media contents to an electronic device, such as the second electronic device 102*b*, or to different electronic devices may be based on a predetermined criterion. In an embodiment, such communication of different media contents to one or different electronic devices may be in response to the input received from the second electronic device 102*b*, via the UI.

In an embodiment, the processor 202 may be operable to convert the received media content (from the network operator (not shown)) from a first format to a second format. For example, the second format may have picture dimensions, such as picture size or aspect ratio, smaller than the received media content in the first format. The media content in the second format may be communicated to one or more electronic devices, such as the second electronic device 102*b*.

In an embodiment, the processor 202 may be operable to generate a notification for one or more electronic devices, such as the second electronic device 102*b*. Such generation of the notification may occur when an updated content may be available in the menu navigation system of the first electronic device 102*a*. Such updated content may be selected via the second electronic device 102*b*.

In an embodiment, the processor 202 may be operable to communicate the generated notification to one or more electronic devices, such as the second electronic device 102*b*. In an embodiment, the processor 202 may be operable to communicate the notification as a message, to the second electronic device 102*b*, via the transceiver 210.

In an embodiment, the processor 202 may be operable to detect one or more human faces that may view the first electronic device 102*a*, such as a TV. In an embodiment, the processor 202 may be operable to generate a notification for the second electronic device 102*b*, when the count of human faces is detected to be zero. Such notification may comprise a message with information associated with the first electronic device 102*a*. For example, the message may be a suggestion, such as "Message from <ID: first electronic device 102*a*>: Nobody is watching the <first electronic device 102*a*: ID>, please turn off". In an embodiment, the processor 202 may be operable to communicate the generated notification to one or more electronic devices, such as the second electronic device 102*b*. Based on the received notification, the second electronic device 102*b* may be operable to receive input, via the UI, to change the state of the first electronic device 102*a*, such as the first electronic device may be turned-off remotely.

Figure 3:
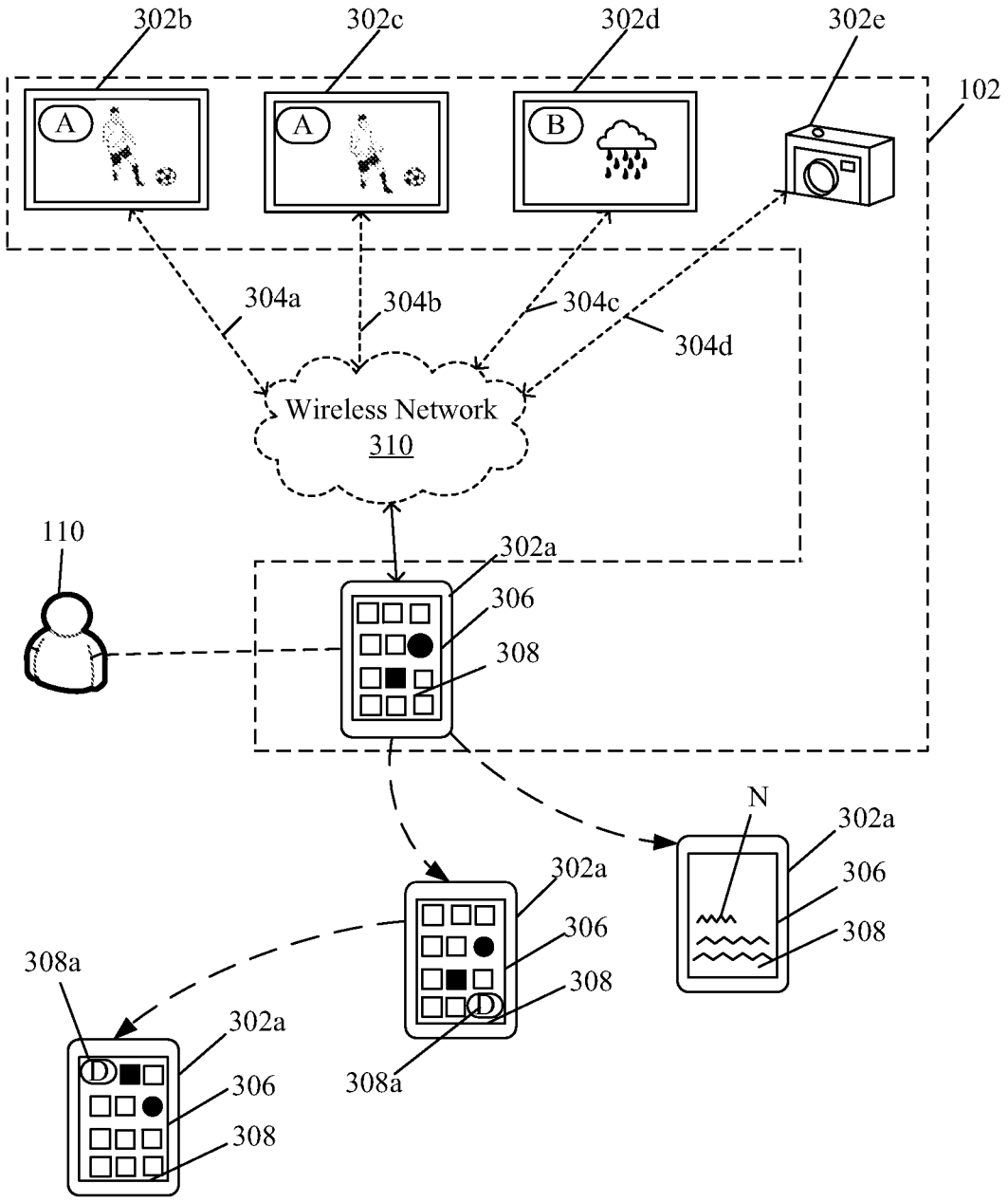
FIG. 3 illustrates a first exemplary scenario for remote interaction via a user interface, in accordance with an embodiment of the disclosure.

FIG. 3 illustrates a first exemplary scenario for remote interaction via the UI in a consumer electronics showroom, in accordance with an embodiment of the present disclosure. FIG. 3 is explained in conjunction with elements from FIG. 1 and FIG. 2. With reference to FIG. 3, there is shown the plurality of electronic devices 102, such as a smartphone 302*a*, a first TV 302*b*, a second TV 302*c*, a third TV 302*d*, a camera 102*e*, a plurality of second communication channels 304*a* to 304*d*, a display screen 306, a UI 308, and the user 110. The UI 308 rendered on the display screen 306 of the smartphone 302*a* may include multiple UI elements, such as a control button 308*a*. There is further shown a wireless network 310, and a notification N.

In accordance to the first exemplary scenario, the smartphone 302*a* may correspond to the first electronic device 102*a*. The first TV 302*b* may be of a first manufacturer of a model, "X", and may correspond to the second electronic device 102*b*. The second TV 302*c* may also be of the first manufacturer of the model, "X", and may correspond to the third electronic device 102*c*. The third TV 302*d* may be of a second manufacturer of a model, "Y". The camera 302*e* may be of the first manufacturer. The third TV 302*d* and the camera 302*e* may be similar to the fourth electronic device 102*d*. The wireless network 310 may correspond to the first communication network 106. The first TV 302*b* and the second TV 302*c* may be operable to display a soccer match on a sports program channel, such as "A". The third TV 302*d* may be operable to display a news channel, such as "B". The camera 302*e* may be in a power-on state.

In operation, the processor 202 of the smartphone 302*a* may be operable to detect close proximity of the smartphone 302*a* to the first TV 302*b*, the second TV 302*c*, the third TV 302*d*, and the camera 302*e*, by use of the sensing device 208. The processor 202 may be operable to establish the plurality of first communication channels, between the smartphone 302*a* and each of the plurality of the electronic devices 102. The plurality of first communication channels may be established by use of the first communication protocol, such as the NFC protocol. The plurality of second communication channels 304*a* to 304*d* may be dynamically established based on the established plurality of the first communication channels. The plurality of second communication channels 304*a* to 304*d* may use the second communication protocol, such as the BT protocol. Data associated with the first TV 302*b* may be received by the transceiver 210 of the smartphone 302*a*. The data may be received via the established second communication channel 304*a*.

In an embodiment, the processor 202 may be operable to dynamically generate the UI 308, based on the data received from the first TV 302*b*. The received data may be control information that may correspond to an identification data of the first TV 302*b*, and one or more functionalities of the first TV 302*b*. The processor 202 may be further operable to dynamically update the UI 308. The update may be based on a plurality of other control information received from the first TV 302*b*, the second TV 302*c*, the third TV 302*d*, and the camera 302*e*. The plurality of other control information may be received via the plurality of the second communication channels 304*b* to 304*d*.

In an embodiment, the smartphone 302*a* may be operable to receive an input that may control the first TV 302*b*, the second TV 302*c*, the third TV 302*d*, and/or the camera 302*e*, via the updated UI 308. The updated UI 308 may comprise one or more UI elements that may correspond to functionalities of the plurality of electronic devices 102. Each UI element on the updated UI 308 may correspond to one of a functionality associated with the first TV 302*b*, the second TV 302*c*, the third TV 302*d*, the camera 302*e*, and/or a common functionality associated with the first TV 302*b*, the second TV 302*c*, the third TV 302*d*, and/or the camera 302*e*. The processor 202 of the smartphone 302*a* may be operable to receive an input, via the updated UI 308, to control the first TV 302*b*, such as to change the channel, "A", to channel, "D", or to change volume. The processor 202 may be operable to process and communicate a command, which may correspond to the received input, to the first TV 302*b*. In response to the received command from the smartphone 302*a*, the first TV 302*b* may be operable to display the channel, "D", or output changed volume. The control or change may be realized at the first TV 302*b* (of the first manufacturer of the model, "X") without affecting the control (such as display of channel, "A") at the second TV 302*c* (also of the first manufacturer and of the same model, "X").

Similarly, the smartphone 302*a* may be operable to receive input, via the updated UI 308, to control the third TV 302*d*, such as to change the channel, "B", to the channel, "C" (not shown). Thus, the first TV 302*b*, the second TV 302*c*, the third TV 302*d*, and/or the camera 302*e*, may be controlled separately and unambiguously for a same functionality, such as the channel or volume change. Such control may occur via the UI 308, without the need to switch between different interfaces or applications at the smartphone 302*a*. The processor 202 of the smartphone 302*a* may be further operable to receive an input to simultaneously control the first TV 302*b*, the second TV 302*c*, the third TV 302*d*, and/or the camera 302*e*, for a common functionality, such as to turn-off power or to mute volume for all such electronic devices with one input. Thus, such common functionalities may minimize user effort, such as in a showroom environment that comprises the plurality of electronic devices 102, the user 110 may want to control the plurality of electronic devices 102.

In an embodiment, the processor 202 may be operable to store user profile data associated with selection of the one or more UI elements on the updated UI 308. In an embodiment, the user profile data may be further associated selection of one or more menu items from a menu navigation system of the first TV 302*b*.

In an embodiment, the processor 202 may be operable to update one or more UI elements on the updated UI 308, based on the stored user profile data. For example, the UI element (most used) of the third TV 302*d*, and an application icon, such as the control button 308*a* of a movie streaming application, "D", may dynamically appear in top row of the UI 308. The control button of the third TV 302*d* may dynamically appear next to the control button 308*a* of a movie streaming application, "D". The control button 308*a* of the movie streaming application, "D", may be updated on the UI 308 based on the stored user profile data.

The transceiver 210 of the smartphone 302*a* may be operable to receive the notification N, such as a "Message from <second TV 302*c*>: The new release movie, "Y", is available to order on showcase movie channel, "123", from one or more of the plurality of the electronic devices 102. Such notification, "N", may occur when an updated content may be available in the menu navigation system of the first TV 302*b*, the second TV 302*c*, the third TV 302*d*, and/or the camera 302*e*. The updated content, such as the new release movie, "Y", may be selected from the UI 308 displayed on the display screen 306 of the smartphone 302*a*.

Figure 4:
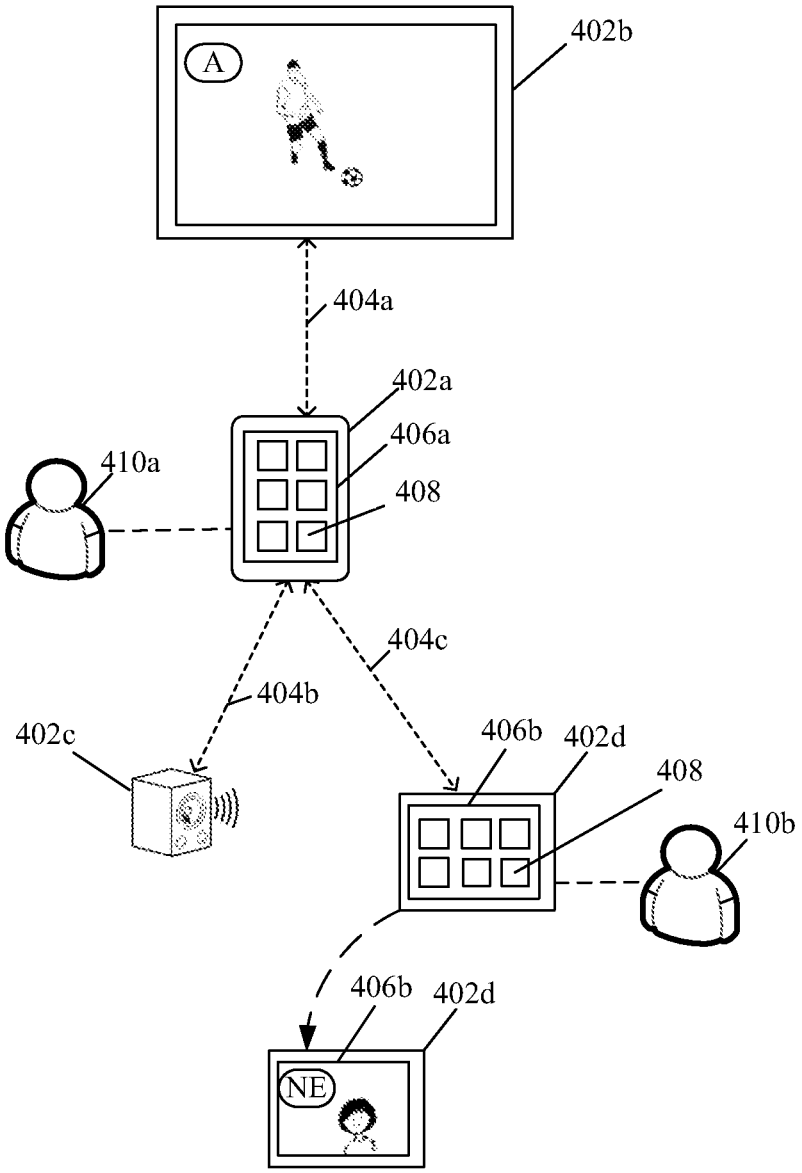
FIG. 4 illustrates a second exemplary scenario for remote interaction via a user interface, in accordance with an embodiment of the disclosure.

FIG. 4 illustrates a second exemplary scenario for remote interaction via the UI, in accordance with an embodiment of the present disclosure. FIG. 4 is explained in conjunction with elements from FIG. 1 and FIG. 2. With reference to FIG. 4, there is shown a first smartphone 402*a*, a TV 402*b*, a wireless speaker 402*c*, a second smartphone 402*d*, a plurality of second communication channels 404*a* to 404*c*, and one or more users, such as a first user 410*a* and a second user 410*b*. The first smartphone 402*a* may include a display screen 406*a* and a UI 408. The UI 408 may be rendered on the display screen 406*a* of the first smartphone 402*a*. The second smartphone 402*d* may include another display screen 406*b* and the UI 408. The UI 408 may be rendered on the display screen 406*b* of the second smartphone 402*d*. The first user 410*a* may be associated with the first smartphone 402*a*. The second user 410*b* may be associated with the second smartphone 402*d*.

In accordance with the second exemplary scenario, the first smartphone 402*a* may correspond to the first electronic device 102*a*. The TV 402*b* may correspond to the second electronic device 102*b*. The wireless speaker 402*c* may correspond to the third electronic device 102*c*. Lastly, the second smartphone 402*d* may correspond to the fourth electronic device 102*d*. The display screen 406*a* and the display screen 406*b*, may be similar to the display screen of the first electronic device 102*a*.

The TV 402*b* may be operable to display a soccer match on a sports program channel, such as "A". The wireless speaker 402*c* may not have sensors that detect close proximity and/or may not use the first communication protocol, such as the NFC protocol. The first user 410*a* may want to listen to audio of the displayed media content (such as a soccer match), from the associated electronic device (such as the wireless speaker 402*c*). The second user 410*b* may want to view a channel, such as a news channel, "NE", which may be different from the channel, "A", displayed at the TV 402*b*.

In operation, the processor 202 of the first smartphone 402*a* may be operable to establish the first communication channel between the first smartphone 402*a* and the TV 402*b*, by use of the first communication protocol (such as the USB). Based on the established first communication channel, the second communication channel 404*a*, such as the 2-way radio frequency band, may be dynamically established between the first smartphone 402*a* and the TV 402*b*. The second communication channel 404*a* may use the second communication protocol, such as the BT protocol. The first communication channel may be established based on a physical contact, such as "a tap", of the first smartphone 402*a* with the TV 402*b*. Data, such as control information, associated with the TV 402*b* may be received by the transceiver 210 of the first smartphone 402*a*. In an embodiment, the control information may be received via the established second communication channel 404*a*. The control information may correspond to an identification data of the TV 402*b* and one or more functionalities of the TV 402*b*. The processor 202 of the first smartphone 402*a* may be operable to dynamically generate the UI 408, based on the control information received from the TV 402*b*.

The first smartphone 402*a* may be further operable to communicate the received data from the TV 402*b* to the wireless speaker 402*c* and the second smartphone 402*d*. In an embodiment, the received data may correspond to the media content. Such communication may occur via the plurality of second communication channels, such as the second communication channels 402*b* and 402*c*. The second communication channels 402*b* and 402*c* may use the second communication protocol, such as the BT protocol. In an embodiment, the second smartphone 402*d* and the wireless speaker 402*c*, may be previously paired with the first smartphone 402*a*. The second smartphone 402*d* may be operable to dynamically generate the UI 408, based on the control information received from the first smartphone 402*a*. In an embodiment, the second smartphone 402*d* may be operable to display the generated UI 408 on the display screen 406*b* of the second smartphone 402*d*.

The first smartphone 402*a* may be operable to receive input (provided by the first user 410*a*), via the UI 408 to control the TV 402*b*, the wireless speaker 402*c*, and the second smartphone 402*d*. For example, the first smartphone 402*a* may be operable to receive input, via the UI 408, to receive audio content of a displayed soccer match from the TV 402*b*. The input may be communicated to the TV 402*b*. The TV 402*b* may be operable to communicate the audio content to the first smartphone 402*a*. The first smartphone 402*a* may further communicate the received audio content to the wireless speaker 402*c*. Thus, the wireless speaker 402*c* may be operable to receive audio content of the soccer match routed via the first smartphone 402*a*.

The first smartphone 402*a* may be operable to receive input (provided by the first user 410*a*), via the UI 408, rendered on the display screen 406*a*, to control the TV 402*b*. For example, the first smartphone 402*a* may be operable to receive input to preview a channel, such as the news channel, "NE", on the display screen 406*a* of the first smartphone 402*a*. The input may be communicated to the TV 402*b*. The TV 402*b* may be operable to further communicate media content, such as the news channel, "NE", to the first smartphone 402*a*, based on the received input. Thus, the TV 402*b* may simultaneously communicate the audio content of the soccer match and the audio-video content of the news channel, "NE", to the first smartphone 402*a*.

The first smartphone 402*a* may be operable to further communicate the received media content, such as the news channel, "NE", to the second smartphone 402*d*. The second smartphone 402*d* may be operable to receive the news channel, "NE", from the TV 402*b*, routed via the first smartphone 402*a*. The second smartphone 402*d* may be further operable to display the received media content, such as the news channel, "NE", on the display screen 406*b* of the second smartphone 402*d*. The second user 410*b* may plug a headphone to the second smartphone 402*d*. Thus, the first user 410*a* may view the soccer match on the channel, "A", at the TV 402*b*, without a disturbance.

In an embodiment, the second user 410*b* may tap the second smartphone 402*d* with the TV 402*b*. The UI 408 may be dynamically launched based on the physical contact (the tap). The second user 410*b* may decide to change the channel, "A", at the TV 402*b*, via the UI 408, rendered at the display screen 406*b*.

In an embodiment, the first smartphone 402*a* may be operable to receive input, via the UI 408, to assign one or more access privileges for media content to other electronic devices, such as the second smartphone 402*d*. The processor 202 of the first smartphone 402*a* may be operable to assign the one or more access privileges for the media content to the second smartphone 402*d*, as per the received input. For example, the access privileges may be limited to certain channels or control buttons. Thus, the dynamically generated UI 408 may optimize usage of the plurality of electronic devices 102, such as the first smartphone 402*a*, the TV 402*b*, the wireless speaker 402*c*, and the second smartphone 402*d*.

Figure 5:
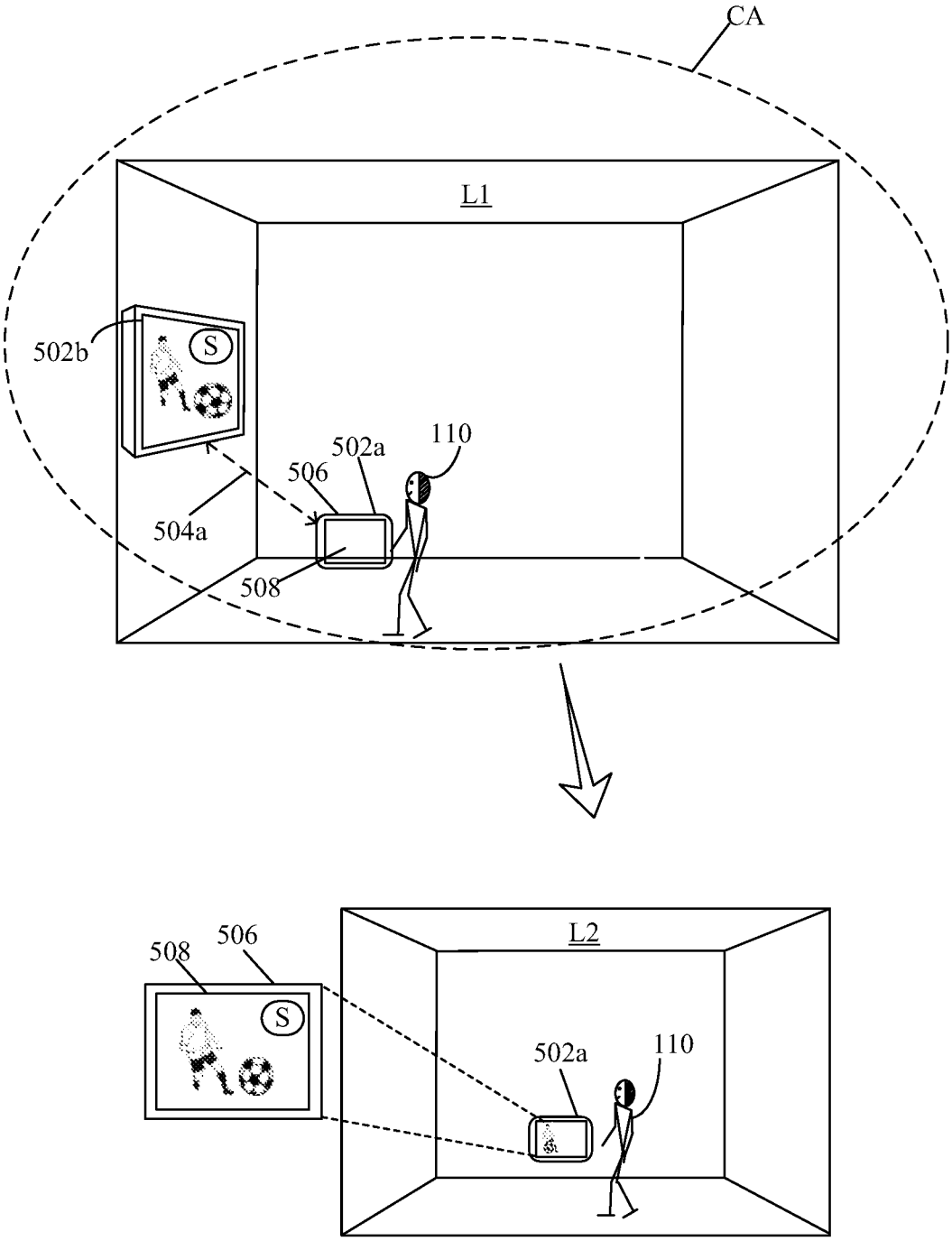
FIG. 5 illustrates a third exemplary scenario for remote interaction via a user interface, in accordance with an embodiment of the disclosure.

FIG. 5 illustrates a third exemplary scenario for remote interaction, in accordance with an embodiment of the present disclosure. FIG. 5 is explained in conjunction with elements from FIG. 1 and FIG. 2. With reference to FIG. 5, there is shown a first location, "L1", a second location, "L2", a coverage area, "CA" of the established second communication channel, a tablet computer 502*a*, an IPTV 502*b*, and a UI 508, rendered on a display screen 506 of the tablet computer 502*a*. There is further shown the user 110 that may be associated with the tablet computer 502*a*.

In the third exemplary scenario, the first location, "L1", and the second location, "L2", may correspond to two separate locations, such as two different rooms in a household. The tablet computer 502*a* may correspond to the first electronic device 102*a*. The IPTV 502*b* may correspond to the second electronic device 102*b*. The display screen 506 of the tablet computer 502*a* may correspond to the display screen of the first electronic device 102*a*. The IPTV 502*b* may be operable to display a soccer match on a sports program channel, such as "S". The user 110 may view the IPTV 502*b* in the first location, "L1", such as a living room. The tablet computer 502*a* may be communicatively coupled with the IPTV 502*b*, via the established second communication channel 504*a*. The tablet computer 502*a* (first electronic device 102*a*) may be operable to control the IPTV 502*b* (second electronic device 102*b*), via the UI 408, rendered on the display screen 506 of the tablet computer 502*a*.

The user 110 may need to move to the second location, "L2", such as a kitchen, for some unavoidable task. The user 110 may hold the tablet computer 502*a* and move beyond the coverage area, "CA", of the established second communication channel, such as the established BT range associated with the controlled IPTV 502*b*. As soon as the tablet computer 502*a* is moved beyond the coverage area, "CA", the processor 202 of the tablet computer 502*a* may be operable to receive a media content, such as the channel, "S", that may be same as the media content displayed on the IPTV 502*b*. The receipt may occur via the third communication protocol, such as the TCP\IP or HTTP protocol, via the transceiver 210. The processor 202 of the tablet computer 502*a* may be further operable to dynamically display the received media content, such as the channel, "S", on the display screen 506. Thus, the user 110 may experience a seamless viewing of the media content, such as the soccer match.

Figure 6A:
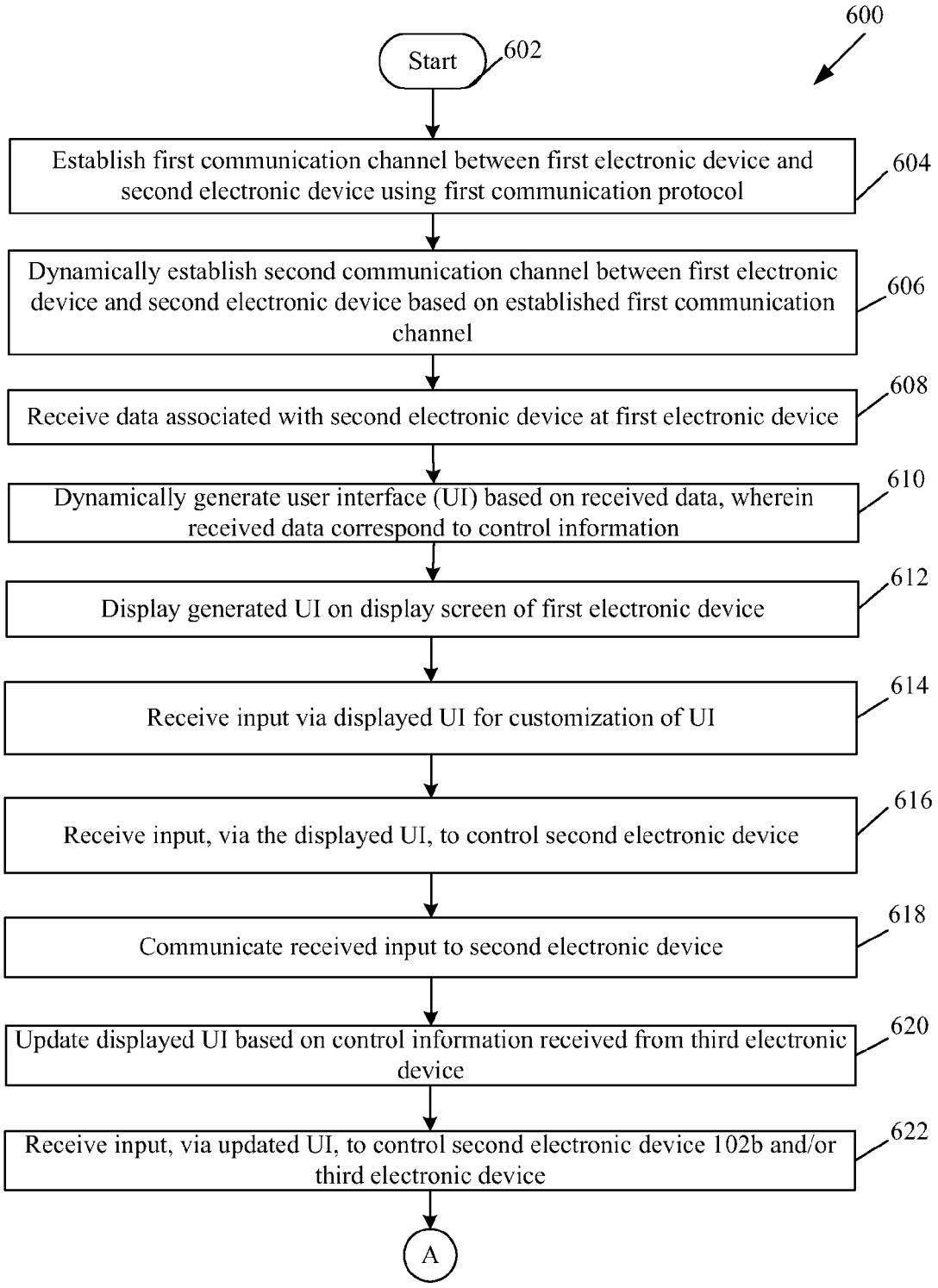
FIGS. 6A and 6B are flow charts that illustrate an exemplary method for remote interaction via a user interface, in accordance with an embodiment of the disclosure.
Figure 6B:
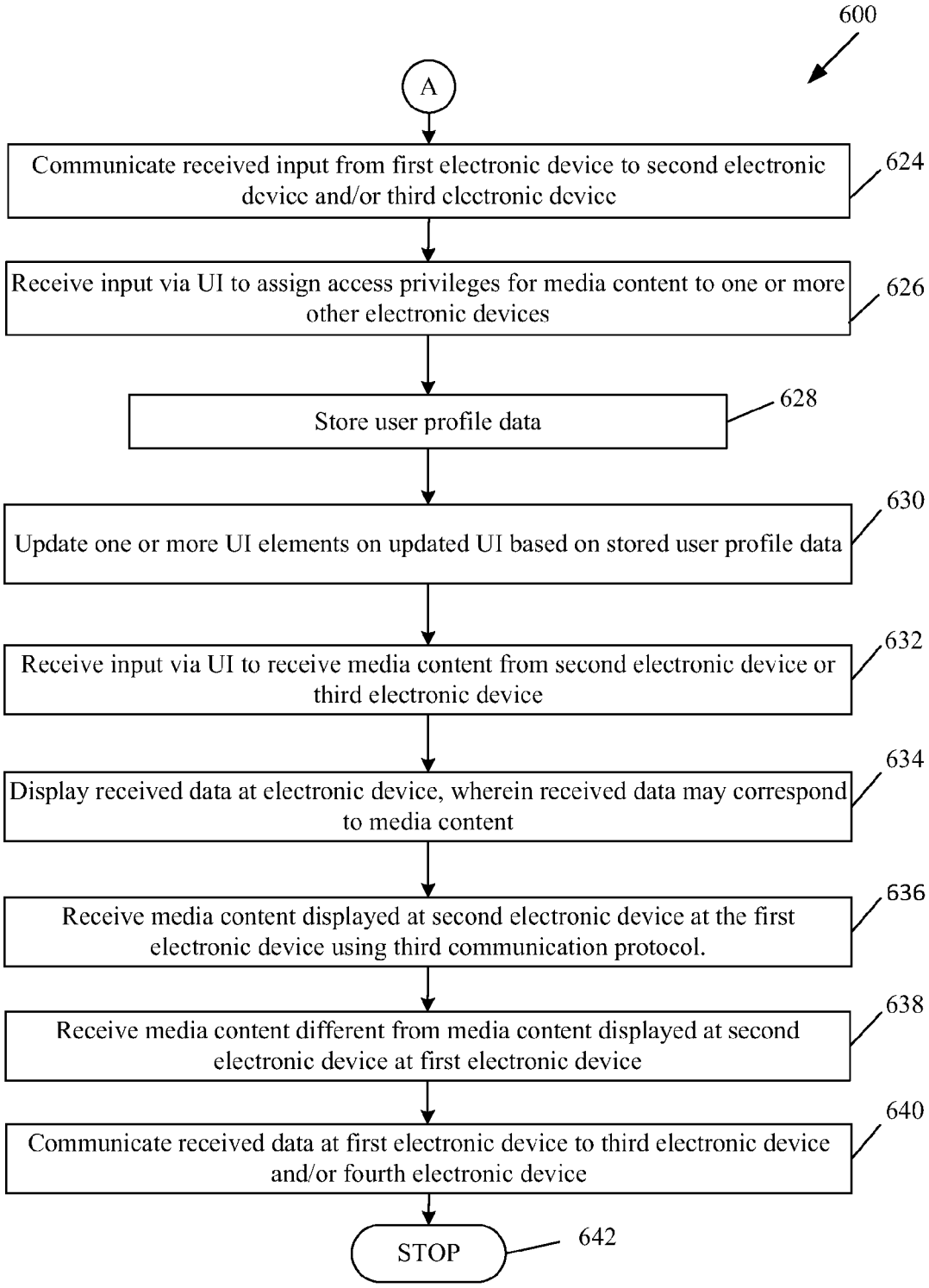

FIGS. 6A and 6B are an exemplary flow chart that illustrates an exemplary method for remote interaction via the UI, in accordance with an embodiment of the disclosure. With reference to FIGS. 6A and 6B, there is shown a flow chart 600. The flow chart 600 is described in conjunction with FIGS. 1 and 2. The method starts at step 602 and proceeds to step 604.

At step 604, a first communication channel may be established between the first electronic device 102*a* and the second electronic device 102*b*, by use of a first communication protocol. At step 606, a second communication channel may be dynamically established between the first electronic device 102*a* and the second electronic device 102*b*, based on the established first communication channel. The second communication channel may use a second communication protocol.

At step 608, data associated with the second electronic device 102*b* may be received, via the established second communication channel. In an embodiment, the received data may be control information. At step 610, a UI may be dynamically generated based on the received data.

At step 612, the generated UI may be displayed on the display screen of the first electronic device 102*a*. At step 614, an input may be received, via the displayed UI, for customization of the UI. The customization may correspond to the selection and/or re-arrangement of one or more UI elements of the UI.

At step 616, an input may be received, via the displayed UI, to control the second electronic device 102*b*. At step 618, the received input may be communicated to the second electronic device 102*b* to control the second electronic device 102*b*.

At step 620, the displayed UI may be dynamically updated based on another control information received from the third electronic device 102*c*. At step 622, an input may be received to control the second electronic device 102*b* and/or the third electronic device 102*c*, via the updated UI.

At step 624, the received input may be communicated from the controlled first electronic device 102*a* to the second electronic device 102*b* and/or the third electronic device 102*c*. At step 626, an input may be received, via the UI, to assign access privileges for media content to one or more other electronic devices, such as the fourth electronic device 102*d*. The one or more other electronic devices may be different from the first electronic device 102*a* and the second electronic device 102*b*.

At step 628, a user profile data may be stored. The user profile data may be associated with selection of the one or more UI elements on the updated UI. The user profile data may be further associated with selection of one or more menu items from a menu navigation system of the second electronic device 102*b*. At step 630, one or more UI elements may be updated based on the stored user profile data.

At step 632, an input may be received, via the displayed UI, to receive media content at the first electronic device 102*a*. The media content may be received from the controlled second electronic device 102*b* or the third electronic device 102*c*. At step 634, the received data may be displayed at the first electronic device 102*a*. The received data may correspond to the media content.

At step 636, media content that may be displayed at the second electronic device 102*b* may be received at the first electronic device 102*a*, by use of a third communication protocol. The media content may be received when the first electronic device 102*a* is moved beyond a predetermined coverage area of the established second communication channel. At step 638, media content that may be different from media content displayed at the second electronic device 102*b* may be received at the first electronic device 102*a*. The receipt of media content may be by use of the third communication protocol, when the first electronic device 102*a* is moved beyond a predetermined coverage area of the established second communication channel.

At step 640, the received data at the first electronic device 102*a* may be communicated to the controlled third electronic device 102*c* and/or the fourth electronic device 102*d*. Control passes to end step 642.

Figure 7:
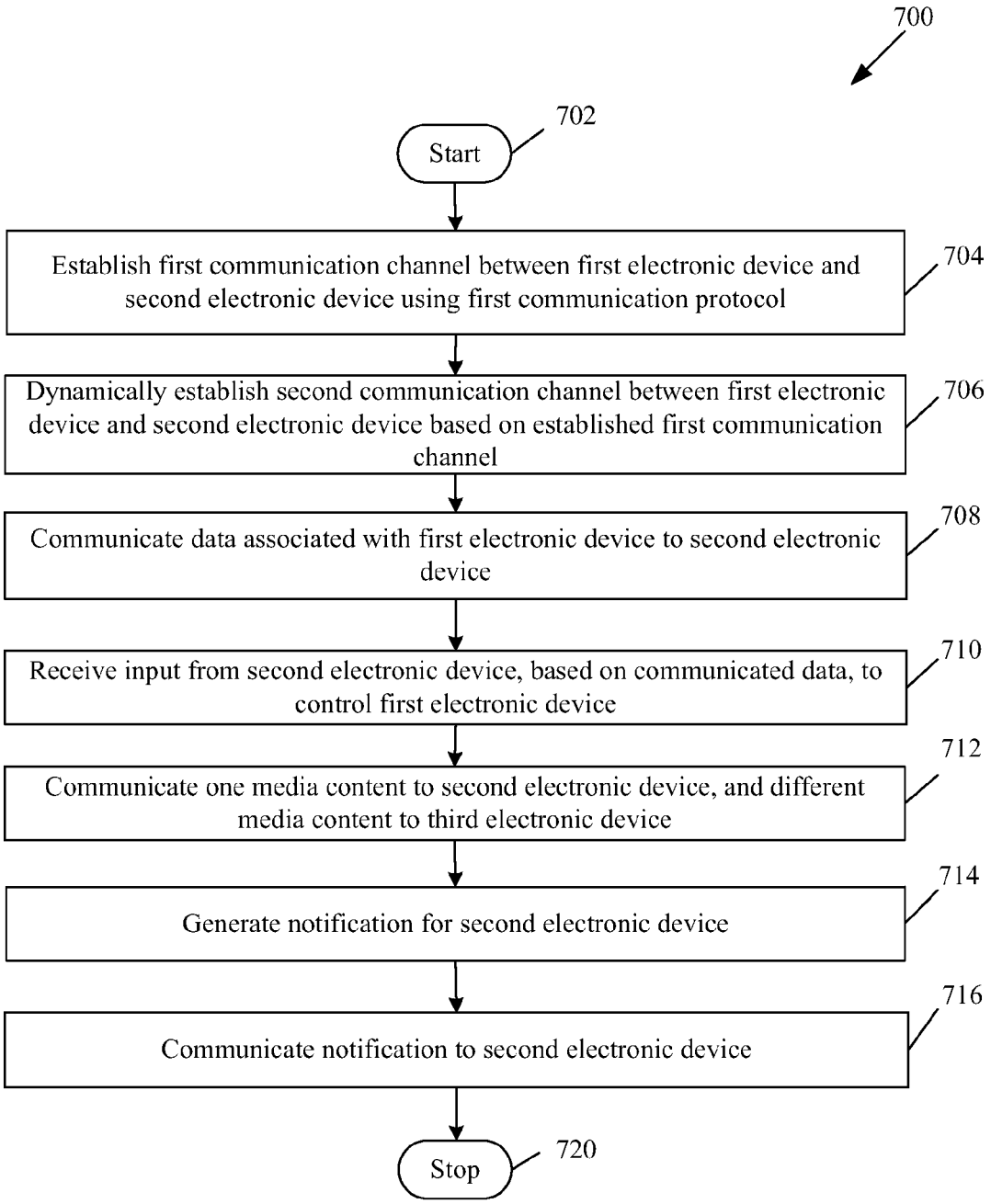
FIG. 7 is a flow chart that illustrates another exemplary method for remote interaction via a user interface, in accordance with an embodiment of the disclosure.

FIG. 7 is an exemplary flow chart that illustrates another exemplary method for remote interaction via the UI, in accordance with an embodiment of the disclosure. With reference to FIG. 7, there is shown a flow chart 700. The flow chart 700 is described in conjunction with FIGS. 1 and 2. The method starts at step 702 and proceeds to step 704.

At step 704, a first communication channel may be established between the first electronic device 102*a* and the second electronic device 102*b*, by use of a first communication protocol. At step 706, a second communication channel may be dynamically established between the first electronic device 102*a* and the second electronic device 102*b*, based on the established first communication channel. The second communication channel may use a second communication protocol.

At step 708, data associated with the first electronic device 102*a* may be communicated to the second electronic device 102*b*, via the established second communication channel. At step 710, an input may be received from the second electronic device 102*b*, based on the communicated data, to control the first electronic device 102*a*.

At step 712, one media content may be communicated to the second electronic device 102*b*, and a different media content may be communicated to the third electronic device 102*c*. The media content may be communicated based on a user input or a predetermined criterion. At step 714, a notification for the second electronic device 102*b* may be generated. Such notification may be generated when an updated content may be available in a menu navigation system of the first electronic device 102*a*. At step 716, the notification may be communicated to the second electronic device 102*b*. Control passes to end step 718.

In accordance with an embodiment of the disclosure, a system for remote interaction via a UI is disclosed. The first electronic device 102*a* (FIG. 1) may comprise one or more processors (hereinafter referred to as the processor 202 (FIG. 2). The processor 202 may be operable to establish the first communication channel between the first electronic device 102*a* and the second electronic device 102*b* (FIG. 1), by use of the first communication protocol. The second communication channel may be dynamically established by use of the second communication protocol, based on the established first communication channel. The processor 202 may be further operable to receive data associated with the second electronic device 102*b*. The data may be received via the established second communication channel. In an embodiment, the processor 202 may be further operable to communicate data associated with the first electronic device 102*a*. The data may be communicated via the established second communication channel.

Various embodiments of the disclosure may provide a non-transitory computer readable medium and/or storage medium, and/or a non-transitory machine readable medium and/or storage medium having stored thereon, a machine code and/or a computer program having at least one code section executable by a machine and/or a computer for remote interaction. The at least one code section in the first electronic device 102*a* may cause the machine and/or computer to perform the steps that comprise the establishment of a first communication channel between the first electronic device 102*a* and the second electronic device 102*b*, by use of the first communication protocol. A second communication channel may be dynamically established by use of the second communication protocol, based on the established first communication channel. Data associated with the second electronic device 102*b* may be received. The data may be received via the established second communication channel. In an embodiment, data associated with the first electronic device 102*a* may be communicated to the second electronic device 102*b*. The data may be communicated via the established second communication channel.

The present disclosure may be realized in hardware, or a combination of hardware and software. The present disclosure may be realized in a centralized fashion, in at least one computer system, or in a distributed fashion, where different elements may be spread across several interconnected computer systems. A computer system or other apparatus adapted for carrying out the methods described herein may be suited. A combination of hardware and software may be a general-purpose computer system with a computer program that, when loaded and executed, may control the computer system such that it carries out the methods described herein. The present disclosure may be realized in hardware that comprises a portion of an integrated circuit that also performs other functions.

The present disclosure may also be embedded in a computer program product, which comprises all the features enabling the implementation of the methods described herein, and which when loaded in a computer system is able to carry out these methods. Computer program, in the present context, means any expression, in any language, code or notation, of a set of instructions intended to cause a system having an information processing capability to perform a particular function either directly, or after either or both of the following: a) conversion to another language, code or notation; b) reproduction in a different material form.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A method for remote interaction, comprising:

in a first electronic device communicatively coupled with a second electronic device:

establishing a first communication channel between said first electronic device and said second electronic device based on a first communication protocol;

dynamically establishing a second communication channel with said second electronic device using a second communication protocol based on said established said first communication channel;

receiving data associated with said second electronic device via said established said second communication channel;

dynamically generating a user interface (UI) based on said received data; and displaying said generated UI on a display screen of said first electronic device.

2. The method of claim 1, wherein said first communication channel is established based on at least one of a physical contact, or a determined proximity between said first electronic device and said second electronic device.

3. The method of claim 1, wherein said first communication protocol corresponds to at least one of a Near Field Communication (NFC) protocol or a Universal Serial Bus (USB) protocol.

4. The method of claim 1, wherein said second communication protocol corresponds to at least one of a Bluetooth protocol, an infrared protocol, a Wireless Fidelity (Wi-Fi) protocol, or a ZigBee protocol.

5. The method of claim 1, wherein said received data is control information that corresponds to an identification data of said second electronic device and at least one functionality of said second electronic device.

6. The method of claim 1, further comprising receiving input via said displayed UI for customization of said UI, wherein said customization corresponds to one of selection or re-arrangement of at least one of UI element of said UI.

7. The method of claim 1, further comprising receiving input via said displayed UI for controlling said second electronic device.

8. The method of claim 1, further comprising receiving input via said displayed UI to assign access privileges for media content to at least one third electronic device, wherein said at least one third electronic device is communicatively coupled to said first electronic device.

9. The method of claim 1, further comprising receiving input via said displayed UI to receive media content at said first electronic device from at least one third electronic device.

10. The method of claim 1, further comprising dynamically updating said displayed UI that comprises a plurality of UI elements based on control information received from a third electronic device, wherein said third electronic device is communicatively coupled to said first electronic device.

11. The method of claim 10, further comprising receiving an input for dynamically controlling said second electronic device or said third electronic device using said updated UI.

12. The method of claim 10, wherein each control element of said plurality of UI elements corresponds to at least one of a functionality associated with said second electronic device, a functionality associated with said third electronic device or a common functionality associated with both of said second electronic device and said third electronic device.

13. The method of claim 10, further comprising storing user profile data associated with selection of said plurality of UI elements on said updated UI, or selection of at least one menu item from a menu navigation system of said second electronic device.

14. The method of claim 13, further comprising updating said plurality of UI elements on said updated UI based on said stored said user profile data.

15. The method of claim 1, wherein said received data corresponds to one of: a first media content currently played at said second electronic device, or a second media content different from said first media content currently played at said second electronic device.

16. The method of claim 1, further comprising displaying said received data, wherein said received data corresponds to a media content.

17. The method of claim 1, further comprising receiving media content that is currently displayed on said second electronic device using a third communication protocol, wherein said media content is received based on determination that said first electronic device is outside a determined coverage area of said established said second communication channel.

18. The method of claim 1, further comprising receiving a first media content that is different from a second media content currently displayed on said second electronic device using a third communication protocol based on a determined coverage area of said established said second communication channel.

19. The method of claim 1, further comprising communicating said received data, corresponding to media content, to a third electronic device or a fourth electronic device, wherein said third electronic device and said fourth electronic device are communicatively coupled with said first electronic device.

20. A method for remote interaction, comprising:

in a first electronic device communicatively coupled with a second electronic device:

establishing a first communication channel between said first electronic device and said second electronic device using a first communication protocol;

dynamically establishing a second communication channel with said second electronic device using a second communication protocol based on said established said first communication channel;

communicating data associated with said first electronic device to said second electronic device, wherein said data is communicated via said established said second communication channel; and receiving input from said second electronic device, based on said communicated data, to control said first electronic device, wherein said communicated data is a control information that corresponds to an identification data of said first electronic device and at least one of functionality of said first electronic device.

21. The method of claim 20, wherein said first communication channel is established based on at least one of a physical contact, or a determined proximity between said first electronic device and said second electronic device.

22. The method of claim 20, wherein said communicated data comprises at least one of a first media content currently played at said first electronic device, or a second media content different from said first media content currently played at said first electronic device.

23. The method of claim 20, wherein said communicated data corresponds to media content that is simultaneously communicated to said second electronic device and a third electronic device, wherein said third electronic device is communicatively coupled to said first electronic device.

24. The method of claim 20, further comprising communicating a first media content to said second electronic device, and a second media content to a third electronic device.

25. The method of claim 20, further comprising communicating a notification to said second electronic device, based on availability of an updated content in a menu navigation system of said first electronic device, wherein said updated content is selected via said second electronic device.

26. A system for remote interaction, comprising:

one or more processors in a first electronic device communicatively coupled with a second electronic device, said one or more processors operable to:

establish a first communication channel between said first electronic device and said second electronic device by use of a first communication protocol;

dynamically establish a second communication channel with said second electronic device by use of a second communication protocol based on said established said first communication channel;

receive data associated with said second electronic device via said established said second communication channel;

dynamically generate a user interface (UI) based on said received data; and display said generated UI on a display screen of said first electronic device.

27. A system for remote interaction, comprising:

one or more processors in a first electronic device communicatively coupled with a second electronic device, said one or more processors operable to:

establish a first communication channel between said first electronic device and said second electronic device by use of a first communication protocol;

dynamically establish a second communication channel with said second electronic device by use of a second communication protocol based on said established said first communication channel;

communicate data associated with said first electronic device to said second electronic device, wherein said data is communicated via said established said second communication channel; and receive input from said second electronic device, based on said communicated data, to control said first electronic device, wherein said communicated data is a control information that corresponds to an identification data of said first electronic device and at least one functionality of said first electronic device.

28. A method, comprising:

in a first electronic device communicatively coupled with a second electronic device:

establishing a first communication channel between said first electronic device and said second electronic device based on a first communication protocol;

dynamically establishing a second communication channel with said second electronic device using a second communication protocol based on said established said first communication channel;

receiving data associated with said second electronic device via said established said second communication channel;

dynamically generating a user interface (UI) based on said received data, wherein said received data is a control information that corresponds to an identification data of said second electronic device and at least one functionality of said second electronic device;

displaying said generated UI on a display screen of said first electronic device; and receiving input via said displayed UI for controlling said second electronic device.

29. A method, comprising:

in a first electronic device communicatively coupled with a second electronic device:

establishing a first communication channel between said first electronic device and said second electronic device based on a first communication protocol;

dynamically establishing a second communication channel with said second electronic device using a second communication protocol based on said established said first communication channel;

receiving data associated with said second electronic device via said established said second communication channel; and receiving media content that is currently displayed on said second electronic device using a third communication protocol, wherein said media content is received based on a determination that said first electronic device is outside a determined coverage area of said established said second communication channel.

* * * * *